United States Patent [19]

Oprean

[11] Patent Number: 4,717,023

[45] Date of Patent: Jan. 5, 1988

[54] CONVENTION BOX

[76] Inventor: George Oprean, 26 Chili Ave., Box 76, Scottsville, N.Y. 14546

[21] Appl. No.: 899,007

[22] Filed: Aug. 22, 1986

[51] Int. Cl.[4] ..... B65D 69/00

[52] U.S. Cl. ..... 206/459; 206/575; 229/147; 229/178

[58] Field of Search ..... 206/575, 577, 459, 472; 229/147, 152, 178, 8.5 R; 190/109, 112

[56] References Cited

U.S. PATENT DOCUMENTS

| | | | |
|---|---|---|---|
| 2,011,880 | 8/1935 | Stein | 190/109 |
| 2,705,587 | 4/1955 | Pidgeon | 229/8.5 |
| 3,225,914 | 12/1965 | Klein et al. | 206/459 |
| 3,229,902 | 1/1966 | Draddy et al. | 229/8.5 |
| 3,826,420 | 7/1974 | Bamberg et al. | 229/147 |
| 3,899,119 | 8/1975 | Roccaforte | 229/147 |
| 3,963,165 | 6/1976 | Hughes | 229/8.5 |
| 4,225,039 | 9/1980 | Skaggs | 229/178 |
| 4,267,959 | 5/1981 | Gilbert | 229/178 |
| 4,433,761 | 2/1984 | Winter et al. | 190/109 |
| 4,511,079 | 4/1985 | Lopez | 229/178 |
| 4,602,712 | 7/1986 | Williams | 229/8.5 |
| 4,667,829 | 5/1987 | Edmund-White | 206/577 |

*Primary Examiner*—George E. Lowrance
*Assistant Examiner*—Brenda J. Ehrhardt
*Attorney, Agent, or Firm*—Bruns and Wall

[57] ABSTRACT

A convention box is folded from a single flat sheet of cardboard, corrugated board or other similar rigid material, to form a disposable yet durable attache case that can be handed out to attendees at a convention or meeting. Side panel members attached to a back panel fold over tabs that are associated with top and bottom panels to lock the box into a rigid, rectangular shape, and also provide rigidity to the side panels. The handles for the convention box are formed as handle halves each formed in a respective front and rear top panel. A slot can be provided in the rear panel for insertion of literature without having to open the box.

16 Claims, 3 Drawing Figures

CONVENTION BOX

BACKGROUND OF THE INVENTION

The present invention relates to boxes or article carriers made of paperboard, corrugated board or the like, and is more particularly directed to a container which can be handed out to attendees at a convention or meeting and can be used for storing and carrying literature, photographs, and other materials that may be obtained at the convention or meeting.

The invention is more particularly directed to a lightweight, inexpensive, simple to assemble, and disposable attache case in the form of a box that is made up out of a single sheet of rigid material, such as paperboard, corrugated board, or the like.

There exists the need for a low-cost but satisfactory convention box, preferably in the form of an attache case or a similar box-like construction that can be handed out to conventioneers and meeting attendees at a meeting or convention site. Generally, at a meeting the attendees accumulate large quantities of literature, handouts, photos, and samples, and the conventional means for carrying this is in a paper or plastic film sack or bag. However, these sacks and bags are not rigid, and the reports, photos, samples, and other handouts can be damaged or bent from handling.

OBJECTS AND SUMMARY OF THE INVENTION

It is an object of this invention to provide an inexpensive, yet durable and easily prepared convention box which can be given away to attendeees at meetings, conferences, and conventions, and which provides a convenient place for storing and carrying literature and other handouts.

It is another object of this invention to provide a convention box which affords advertising space on its front, back and side panels.

In accordance with an object of this invention, a convention box is folded of a flat sheet of material of predetermined thickness, such as corrugated board. This convention box can be handed out to convention or meeting attendees for storage and carriage of literature materials, etc., at the convention or meeting. The convention box is generally of a rectangular shape, and of the general height, width, and depth of a conventional attache case, to wit, about thirteen inches, by about nineteen inches, by about three to four inches. The single-sheet convention box comprises a rectangular back panel of such height and width, a first top panel of that width and of that depth, and joined at a fold line to a top edge of the back panel, the first top panel including rectangular tabs that extend from its side edges at respective fold lines, and that extend out a distance of about half of the box height. These tabs have a width just smaller than the depth by about twice the thickness of the sheet, and provide clearance for side panel groups to be discussed later. A bottom panel forms the base of the box and is of said width and depth and is joined at the fold line to a bottom edge of the back panel. This bottom panel has a pair of rectangular tabs similar to those of the top panel, and which also extend from its side edges at respective fold lines and that extend out a distance about half the box height. These are also of a width just smaller than the depth, that is, by about twice the thickness of the sheet.

A pair of side panel groups are disposed at opposite side edges of the back panel, with each group having a height smaller than the box height by about twice the sheet thickness. The side panel groups each include a first panel member extending out a distance equal to the box depth and joined at a fold line to the respective side edge of the back panel, a second panel member of a width of only about one to three times the sheet thickness, and joined at a fold line to a side edge of the first panel member, and a third panel member of about the same size as the first member and joined at a fold line to a side edge of the second panel member. This third panel member carries on it a pair of protruding stubs which engage elongated openings at the corresponding side edges of the back panel, and these provide engaging means for holding each side panel group, together with folded in associated ones the top and bottom panel tabs together, so that the groups and tabs form substantially rigid, reinforced sides for the convention box.

The box also has a rectangular front panel whose bottom edges join at a fold line to the bottom panel, and which has a width that is smaller than the box width by about eight thicknesses of the sheet, and whose height is just smaller than the box height by about one sheet thickness. Side tabs are formed on the front panel and are joined at fold lines to side edges of the front panel, these side tabs extending out a distance substantially equal to the box depth. A second top panel is joined to the top edge of the front panel at a fold line thereon, and this has the width of the front panel and extends out a distance about equal to the box depth.

A handle is formed in one or both of the first and second top panels, and this handle folds out from the respective top panels. The handle is cut from the top panels to permit the box to close with the front panel side tabs being inside the sides of the convention box and with the second top panel disposed inside the first top panel.

The side tabs of the front panel preferably have rounded corners, and have a sloping or slanting upper edge to facilitate opening and closing of the box. The back panel of the box has a slot extending widthwise for a distance of about the length of a standard sheet of paper, to facilitate insertion of literature into the box without having to open the box. Advertising can be printed on the front and rear panels, as well as on the sides of the box, and on the top panels. In optional embodiments, the Velcro straps or the like can be employed to hold the box shut. Also a folio or envelope can be fastened by pressure sensitive adhesive or the like to the inside of the front panel to retain papers, pencils, etc. This folio can be printed with meeting schedules, lists of speakers and topics, names and telephone numbers of sales contacts, etc., for the benefit of the convention or meeting attendees.

These convention boxes are manufactured and shipped as stacks of flat, single sheets, and can be easily made up by convention personnel without a great deal of training.

The above and many other objects, features, and advantages of this invention will be more fully understood from the ensuing detailed description of a preferred embodiment, which should be considered in connection with the accompanying drawing.

DETAILED DESCRIPTION OF THE PREFERRED EMBODIMENT

Figure 1:
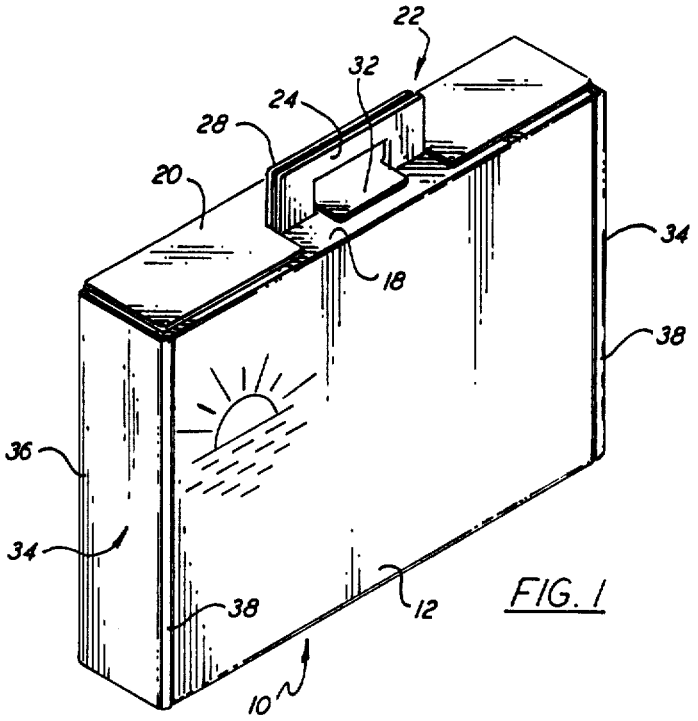
FIG. 1 is a perspective view of the convention box according to an embodiment of this invention.
Figure 2:
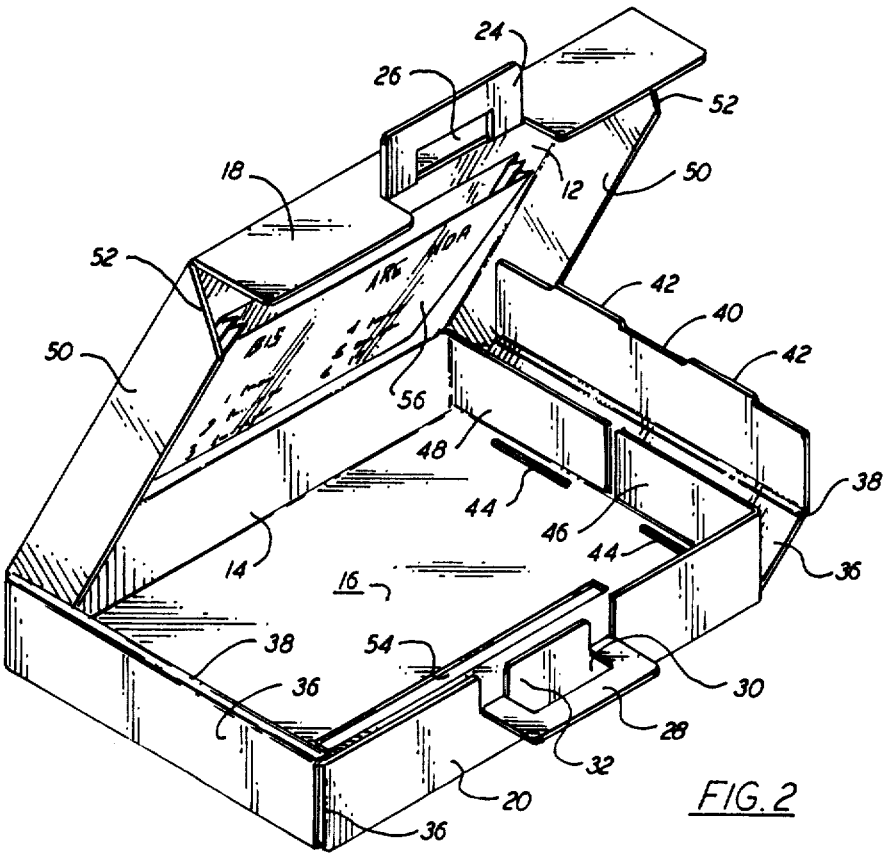
FIG. 2 is another perspective view showing the box as opened out.
Figure 3:
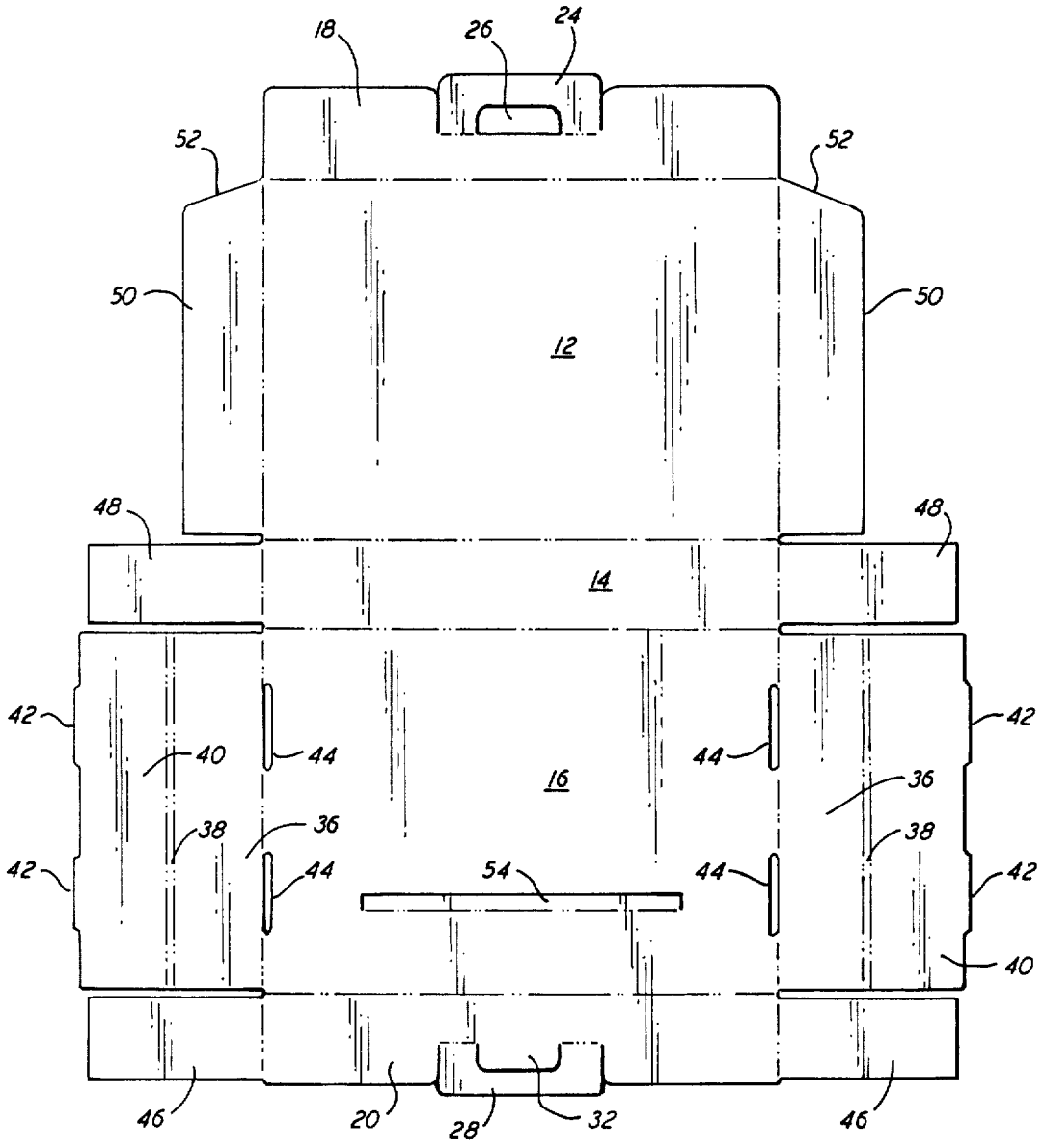
FIG. 3 is a plan view of a unitary sheet of rigid material that is capable of being folded into the embodiment of FIGS. 1 and 2.

With reference to the drawing, and in particular to FIGS. 1–3 thereof, the convention box 10 of this invention is in the form of a cardboard or corrugated board attache case. The box 10 has a front panel 12, a bottom panel 14, and a back panel 16. The front and back panels 12 and 16 are joined at fold lines, shown as chain lines in FIG. 3, to the bottom panel 14. The front and back panels 12 and 16 have at their respective top edges, top panels 18 and 20 joined by fold lines. A handle 22, as shown in FIG. 1, is here a double handle arrangment formed of a front handle half 24 which has a handhold cutout 26 therein, and a rear handle half 28 which has a similar handhold cutout 30 therein. This cutout 30 is formed by a U-shaped die cut line, leaving a projecting tongue 32, which when the box 10 is closed passes through the handhold opening 26 in the front handle half 24. The front and rear halves 24 and 28 have respective fold lines formed about midway across their respective top panels 18 and 20, so that the handle halves 24 and 28 meet over the center of the box 10.

The sides of the box are formed by the folding in of respective side panel groups 34, which are disposed at opposite side edges of the rear panel 16. Each group 34 has a first panel member 36 adjoined at a fold line to the side edge of the panel 16, a second panel member 38, which is only a few thicknesses of the material across, and a third panel member 40 which is substantially the same dimension as the first panel member 36, the three panel members 36, 38, 40 being joined consecutively by respective fold lines. On outer edges of the third panel members 40 there are formed a plurality of projecting stubs 42, which are intended to engage with elongated slots 44 in the rear panel 16 just adjacent their side edges.

The top panel 20 associated with the rear panel 16 has laterally projecting rectangular tabs 46 and the bottom panel 14 has similar projecting rectangular tabs 48. These tabs 46 and 48 have a length about half the height of the box, and have a lateral dimension about equal to the box depth.

Also shown in FIGS. 2 and 3 are side tabs 50 formed at lateral or side edges of the front panel 12. These tabs 50 extend outward a distance about equal to the box depth, and have top edges 52 which slant downwards somewhat to facilitate closure of the box front panel 12. Both the top panel 18 and the tabs 50 have rounded corners also to facilitate closure of the box 10.

To assemble this convention box, the top and bottom panels 20 and 14 are folded upwards (with respect to FIG. 3) and the tabs 46 and 48 are folded inward to lie along the fold line between the back panel 16 and the associated side panel members 36. Then, the third panel member 40 is folded over and down, enclosing the tabs 46 and 48 beneath the second or narrow panel member 38. Now the stubs 42 are engaged in the openings 44. Then, the tabs 50 and the top panel 18 are folded in with respect to the front panel 12, and the handle halves 24 and 28 are folded back with respect to the associated top panels 18 and 20.

The relative dimensions of the panels 12, 14, 16, 18, 20 and the associated tabs 46, 48 and panel member 36, 38, 40 are selected so that the convention box 10 folds together as a stable, and rigid entity. Here, the panels 46 and 48 are approximately two thicknesses smaller in their width dimension than are the panel members 36 and 40, and the front panel 12 is sufficiently smaller than the rear panel 16 to accommodate the thicknesses of the panel members 36 and 40, and the tabs 46, 48 and 50.

A slot 54 is provided in the back panel 16 extending horizontally a few inches from the top edge thereof. In this embodiment, the slot 54 is about eleven inches in length and is one-half inch across. The slot can be completely cut out, or leave a remaining flap, as shown here.

Advertising or other announcements relating to the convention or meeting can easily be printed on the front and back panels 12 and 16. Also, as shown in FIG. 2, a folio or pocket 56 formed of cardboard or heavy paper can be affixed on the inside of the front panel 12 by means of pressure sensitive adhesive or the like. This pocket 56 can provide a convenient place for storing important papers, or pencils and pens. Advertising messages or other information, such as meeting schedules, or important phone numbers can be printed on this folio or pocket 56.

While the invention has been described in detail hereinabove with respect to a single preferred embodiment, it should be recognized that the invention is certainly not limited to that embodiment, and that many modifications and variations thereof would present themselves to those of skill in the art without departure from the scope and spirit of this invention as defined in the appended claims.

I claim:

1. Convention box to be folded from a single flat sheet of rigid material of a predetermined thickness and handed out to convention or meeting attendees or the like for storage and carriage of literature materials at the convention or meeting, the convention box being generally rectangular and of a predetermined overall height, width, and depth, and comprising:

a rectangular back panel of said width and height, a first top panel of said width and depth and joined at a fold line to a top edge of said back panel, said first top panel including retangular tabs extending out from said edges thereof at fold lines a distance substantially half said height, and of a width smaller than said depth by substantially twice the predetermined thickness of said sheet;

a bottom panel forming the base of said box and of said width and depth and joined at a fold line to a bottom edge of said back panel, said bottom panel including a pair of rectangular tabs extending out from side edges thereof at fold lines a distance substantially half said height, and of a width smaller than said depth by substantially twice the predetermined thickness of said sheet;

a pair of side panel groups disposed at opposite side edges of said back panel, each said group having a height smaller than said box height by substantially twice the sheet thickness, and including a first panel member of said depth and joined at a fold line to the respective side edge of said back panel, a second panel member of a width substantially one to three times the sheet thickness and joined at a fold line to the respective side edge of said back panel, a second panel member of a width substantially three times the sheet thickness and joined at a fold line to a side edge of said first panel member, a third panel member joined at a fold line to a side edge of second panel member and of substantially said depth, and means on an outer side edge of said third panel member cooperating with engaging means at the corresponding side edge of said back panel for holding each said group and associated ones of said top and bottom panel tabs, such that said groups and tabs form substantially rigid, reinforced sides of said convention box;

a rectangular front panel having a bottom edge joined at a fold line to said bottom panel and having a width smaller than said box width by several thicknesses of said sheet, and a height smaller than said box height by approximately said sheet thickness;

side tabs joined at fold lines to said edges of said front panel and of substantially said depth, and including means to facilitate opening and closing of the box, a handle formed in at least one of said first and second top panels and folding out from the respective top panel, and permitting said box to close with the front panel side tabs inside the sides of said convention box and with the second top panel disposes inside of said first top panel, wherein one of said rectangular back panel and said rectangular front panel has a slot extending in the width direction thereof for a distance of substantially the length of a standard sheet of paper, for permitting convention or meeting literature to be inserted through it into the box without need to open the box.

2. The convention box of claim 1 in which said handle is a double handle with first and second handle halves being formed of a tab with a handhold cutout therein, the respective handle half tabs being joined to the associated first and second top panels at fold lines spaced about half said depth from the top edge of the connected front and back panels.

3. The convention box of claim 2 in which said first top panel has a tongue in the plane of said top panel and being cut to define the handhold cutout of said first handle half, the tongue protruding through the second handle half handhold cutout and against said second top panel when the box is closed.

4. The convention box of claim 1 wherein said second top panel and the side joined to said front panel have rounded corners to facilitate opening and closing of said box.

5. The convention box of claim 4 wherein said side tabs, at ends thereof adjacent the front panel top edge, have sloping edges to facilitate opening and closing of the box.

6. The convention box of claim 1, wherein the means on said side panel groups includes pairs of protruding elongated stubs on outer edges of said third panel members, and said engaging means includes pairs of elongated mating openings in said back panel adjacent the fold lines that join the back panel to said first panel members.

7. The convention box of claim 1 wherein exterior surfaces of said front and said back panels are printed with advertising relating to said convention or meeting.

8. The convention box of claim 1 wherein said height and width are on the order of about thirteen inches and nineteen inches, respectively.

9. The convention box of claim 8 wherein said depth is about three to four inches.

10. The convention box of claim 9 in which said slot is dimensioned about eleven inches by about one-half inch.

11. The convention box of claim 1 in which said slot is cut on one long side and two ends to leave a flap.

12. Convention box to be folded from a single flat sheet of rigid material of a predetermined thickness, and handed out to convention or meeting attendees or the like for storage and/or carriage of literature materials at the convention or meeting, the convention box being generally rectangular and of a predetermined overall height, width, and depth, comprising:

a back panel of said width and height;

a first top panel joined at a fold line to a top edge of said back panel, including tabs extending laterally from fold lines at ends of said first top panel;

a bottom panel joined to said back panel at a fold line at a bottom edge thereof, and including tabs extending laterally from fold lines at ends of said bottom panel;

a front panel joined at a lower edge thereof by a fold line to said bottom panel at an edge opposite said back panel, and including means to facilitate opening and closing of the box;

a second top panel connected at a fold line to an upper edge of said top panel; and including means connecting with said first top panel to form a combined handle; and side panel group means at opposite side edges of said back panel which fold over said tabs of said bottom panel and said first top panel to form substantially rigid sides for said box, including engaging means for holding said side panel group means folded;

wherein one of said front and back panels has a slot extending in the width direction thereof and for a distance of substantially the length of a standard sheet of paper, to facilitate insertion of literature into the convention box without having to open the box.

13. The convention box of claim 12 wherein said engaging means includes protruding stubs at free ends of said side panel group means and respective engaging slots at side edges of said back panel.

14. The convention box of claim 12 wherein said height, width, and depth are on the order of about thirteen inches, about nineteen inches, and about three to four inches, respectively.

15. The convention box of claim 14 in which said slot is dimensioned about eleven inches by about one-half inch.

16. The convention box of claim 12 in which said first top panel has a first handle portion which folds out therefrom at a location spaced from said back panel top edge, and the cooperating means of said second top panel includes a second handle portion which folds out therefrom at a location spaced from said front panel and cooperates with said first handle portion to form said combined handle.

* * * * *

UNITED STATES PATENT AND TRADEMARK OFFICE

CERTIFICATE OF CORRECTION

PATENT NO. : 4,717,023

DATED : January 5, 1988

INVENTOR(S) : GEORGE OPREAN

It is certified that error appears in the above-identified patent and that said Letters Patent is hereby corrected as shown below:

Column 4, line 46 - "said" should read "side".

Column 5, line 16 - "said" should read "side".

line 23 - "disposes" should read "disposed".

Signed and Sealed this

Twenty-first Day of June, 1988

*Attest:*

*Attesting Officer*

DONALD J. QUIGG

*Commissioner of Patents and Trademarks*